US009634377B2

(12) United States Patent
Lei et al.

(10) Patent No.: US 9,634,377 B2
(45) Date of Patent: Apr. 25, 2017

(54) ELECTRONIC DEVICE

(71) Applicant: Wistron Corp., New Taipei (TW)

(72) Inventors: Chun-Hsiang Lei, New Taipei (TW); Yuan-Cheng Sun, New Taipei (TW); Chien-Ju Chen, New Taipei (TW); Po-Hsien Chu, New Taipei (TW)

(73) Assignee: WISTRON CORP., New Taipei (TW)

( * ) Notice: Subject to any disclaimer, the term of this patent is extended or adjusted under 35 U.S.C. 154(b) by 104 days.

(21) Appl. No.: 14/449,287

(22) Filed: Aug. 1, 2014

(65) Prior Publication Data

US 2015/0171503 A1 Jun. 18, 2015

(30) Foreign Application Priority Data

Dec. 18, 2013 (TW) ..... 102146837 A

(51) Int. Cl.

| | |
|---|---|
| ***H01Q 1/24*** | (2006.01) |
| ***H01Q 1/22*** | (2006.01) |
| ***H01Q 1/48*** | (2006.01) |
| ***H01Q 9/42*** | (2006.01) |

(52) U.S. Cl.

CPC ..... *H01Q 1/2266* (2013.01); *H01Q 1/48* (2013.01); *H01Q 9/42* (2013.01)

(58) Field of Classification Search

CPC ..... H01Q 1/2266; H01Q 1/243
USPC ..... 343/702
See application file for complete search history.

(56) References Cited

U.S. PATENT DOCUMENTS

| | | | | |
|---|---|---|---|---|
| 7,072,690 | B2 * | 7/2006 | Shin | G06F 1/1616 343/702 |
| 7,242,353 | B2 | 7/2007 | Hung et al. | |
| 7,764,236 | B2 * | 7/2010 | Hill | H01Q 1/243 343/702 |
| 8,068,059 | B2 * | 11/2011 | Konishi | G06F 1/1616 343/702 |
| 2001/0052878 | A1 | 12/2001 | Kim et al. | |
| 2003/0124985 | A1 | 7/2003 | Shin et al. | |
| 2010/0073241 | A1 * | 3/2010 | Vazquez | H01Q 1/2266 343/702 |
| 2013/0134225 | A1 * | 5/2013 | Teshima | G06K 19/0723 235/492 |
| 2013/0207853 | A1 * | 8/2013 | Yamamoto | H01Q 1/002 343/702 |

FOREIGN PATENT DOCUMENTS

| | | |
|---|---|---|
| CN | 103247844 | 8/2013 |

* cited by examiner

*Primary Examiner* — Dameon E Levi
*Assistant Examiner* — Hasan Islam
(74) *Attorney, Agent, or Firm* — McClure, Qualey & Rodack, LLP

(57) ABSTRACT

An electronic device is provided. The electronic device includes a housing, a display, a supporting frame and an antenna. The display is disposed in the housing. The supporting frame supports the display. The antenna includes a radiator and a connection section. The connection section is connected to the radiator, wherein the connection section is coupled to the supporting frame.

20 Claims, 5 Drawing Sheets

ELECTRONIC DEVICE

CROSS REFERENCE TO RELATED APPLICATIONS

This Application claims priority of Taiwan Patent Application No. 102146837, filed on Dec. 18, 2013, the entirety of which is incorporated by reference herein.

BACKGROUND OF THE INVENTION

Field of the Invention

The present invention relates to an electronic device, and in particular to an electronic device including an antenna.

Description of the Related Art

In a conventional notebook or tablet computer, an antenna is disposed at a top side of a screen, and is arranged side by side with an image-capturing unit. However, with the increased multifunctional requirements of the notebook (or tablet computer), more and more electronic elements should be disposed at the top of the screen, and the mounting space at the top side of the screen inside the notebook is insufficient. When the antenna is adjacent to the image-capturing unit, noise can occur, and transmission of the antenna is deteriorated.

Additionally, in the conventional notebook or tablet computer, a copper foil ground layer is disposed between the housing and the display, which covers a back side of the display, and is coupled to the antenna as a ground element of the antenna. The conventional design has a complicated assembly process and an increased cost.

BRIEF SUMMARY OF THE INVENTION

An electronic device is provided. The electronic device includes a housing, a display, a supporting frame and an antenna. The display is disposed in the housing. The supporting frame supports the display. The antenna includes a radiator and a connection section. The connection section is connected to the radiator, wherein the connection section is coupled to the supporting frame.

In the embodiment of the invention, the notch is formed on the supporting frame, and therefore there is sufficient space for disposing an antenna at a lateral side of the housing. Utilizing the embodiment of the invention, the antenna can be disposed at the right side or the left side of the display, the space at the top side of the display is prevented from being occupied by the antenna, and sufficient space is preserved for the image-capturing unit and other electronic elements. The noise of signal transmission can be reduced, and the performance of the antenna is improved. In this embodiment, though the notch is formed on the supporting frame, the supporting frame still provides sufficient support for the display.

In the embodiment of the invention, the supporting frame is utilized as a ground element, which provides sufficient ground area. Therefore, there is no copper foil ground layer coupled to the antenna being disposed between the housing and the display. The assembly process is simplified and the cost is reduced. In one embodiment, the supporting frame can be electrically connected to the pivot structure via a connection element (for example, a rivet) to further increase the ground area of the antenna and to achieve and improved ground effect.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
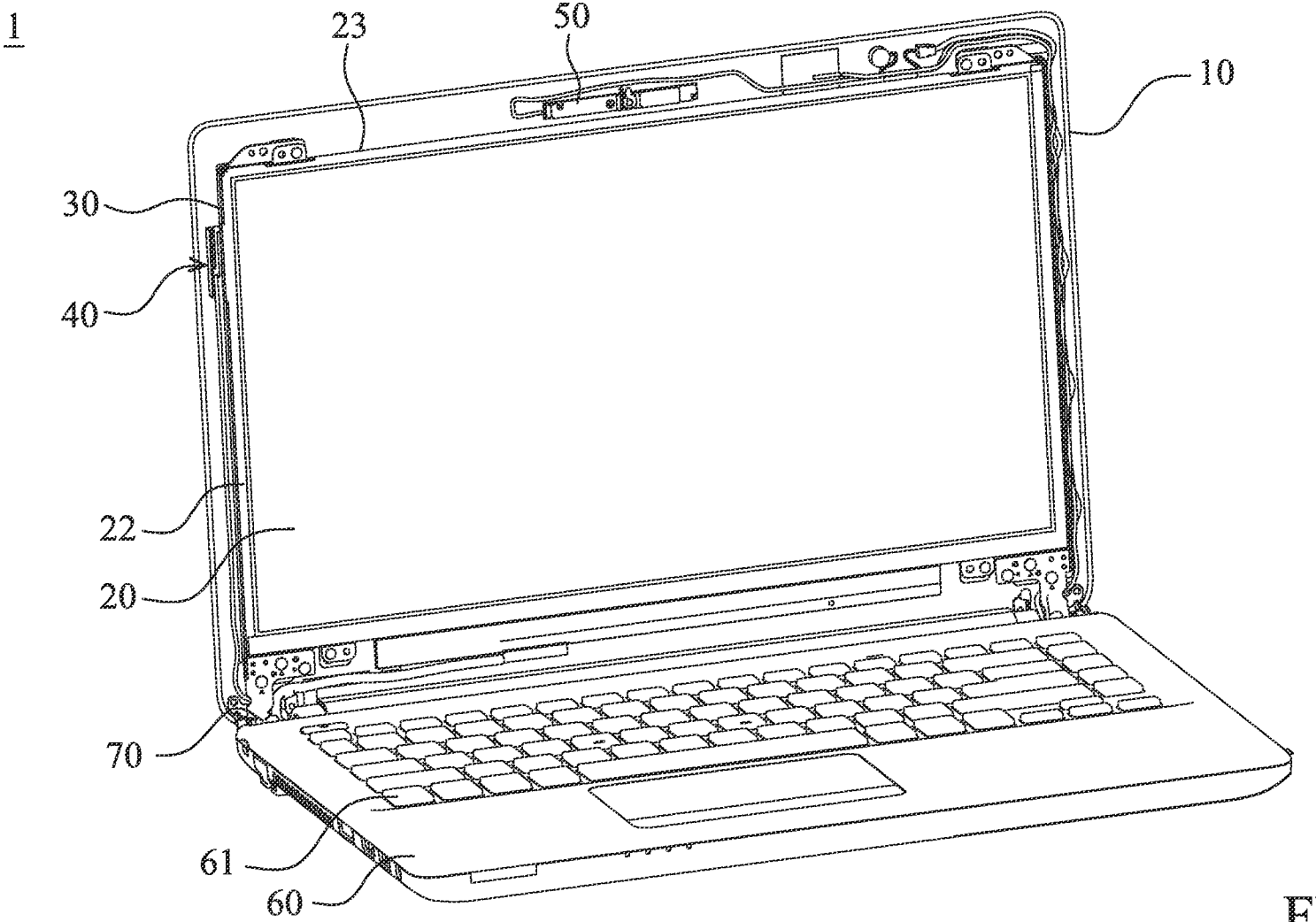
FIG. 1 shows an electronic device of an embodiment of the invention.

FIG. 1 shows an electronic device 1 of an embodiment of the invention, comprising a housing 10, a display 20, a supporting frame 30 and an antenna 40. The display 20 is disposed in the housing 10. The supporting frame 30 contacts and supports the display 20. In this embodiment, the supporting frame 30 contacts the lateral sides (right, left, top and bottom sides) and the back side of the display 20.

Figure 2A:
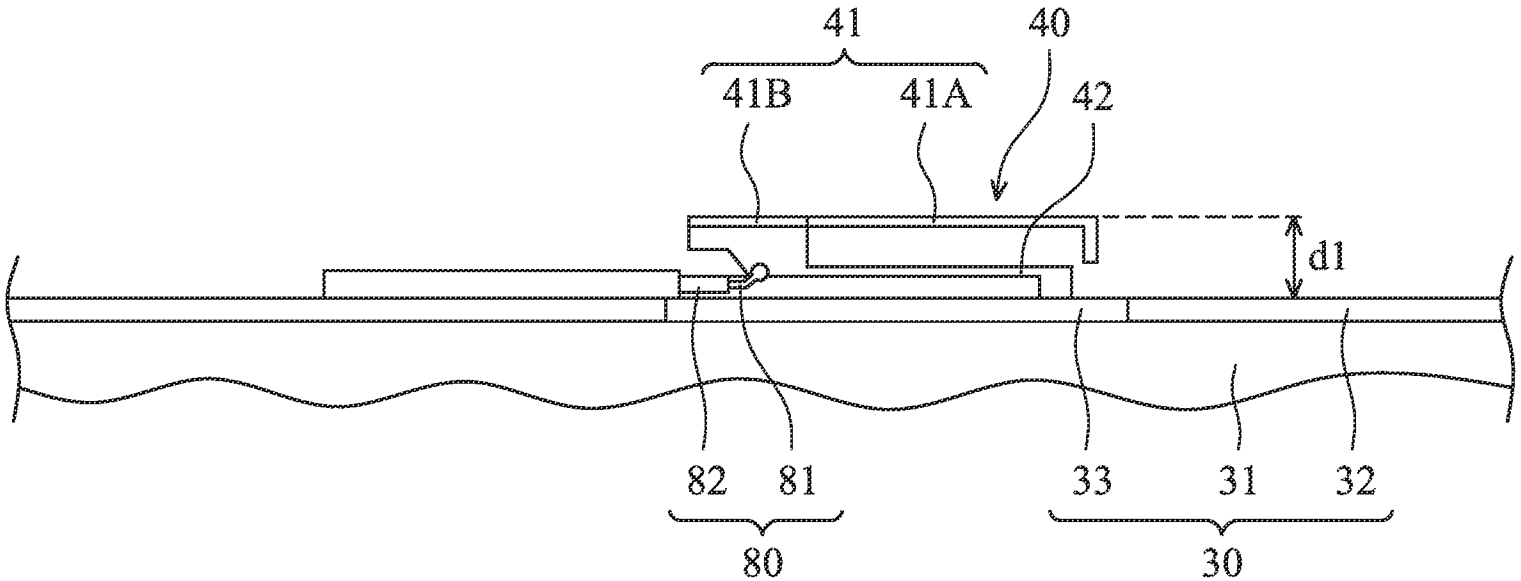
FIG. 2A is a detailed side view of an antenna of the embodiment of the invention.

FIG. 2A shows the detailed structure of the antenna 40. The antenna 40 comprises a radiator 41 and a connection section 42. The connection section 42 is connected to the radiator 41, wherein the connection section 42 is coupled (connected) to the supporting frame 30. In one embodiment, the connection section 42 is connected to the supporting frame 30 by welding. In one embodiment, the connection section 42 provides impedance matching, for example, impedance matching of 50Ω.

With reference to FIG. 2A, the electronic device 1 further comprises a coaxial cable 80. The coaxial cable 80 comprises a signal line 81 and a ground line 82, the signal line 81 is coupled to the radiator 41, the ground line 82 is coupled to the supporting frame 30, and the supporting frame 30 is therefore grounded (In FIGS. 1 and 2B, the coaxial cable is omitted to simplify the drawings).

With reference to FIG. 2A, in one embodiment, the radiator 41 comprises a first arm 41A and a second arm 41B, the first arm 41A and the second arm 42B are respectively connected to the connection section 42, an extension direction of the first arm 41A is opposite to an extension direction of the second arm 41B, and a distance d1 between the first arm 41A and the supporting frame 30 is about 5 mm. In one embodiment, the first arm 41A transmits a wireless signal of 2.45 GHz, and the second arm 41B transmits a wireless signal of 5 GHz.

Figure 2B:
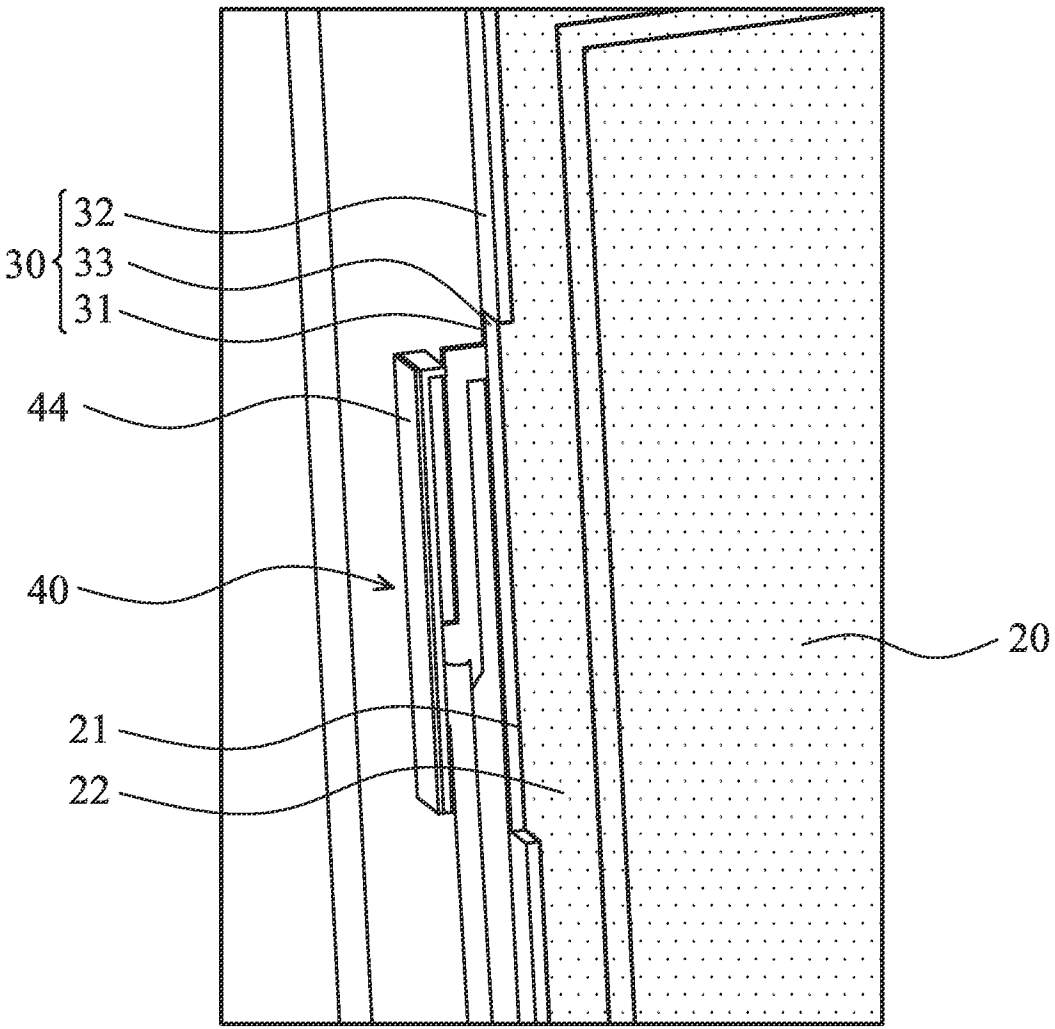
FIG. 2B is a detailed perspective view of the antenna of the embodiment of the invention.

With reference to FIG. 2B, in one embodiment, the antenna 40 further comprises a copper foil layer 44. The copper foil layer 44 covers the first arm 41A and the second arm 41B to further improve the performance of the antenna 40.

With reference to FIGS. 2A and 2B, the supporting frame 30 comprises a first section 31 and a second section 32, the first section 31 is perpendicular to the second section 32, the first section 31 abuts a back side 21 of the display 20, the second section 32 abuts a first lateral side (left side) 22 of the display 20, a notch 33 is formed on the second section 32, and the notch 33 is corresponding to the antenna 40.

With reference to FIG. 1, in one embodiment, the electronic device 1 further comprises an image-capturing unit 50, wherein the image-capturing unit 50 is disposed in the housing 10, the image-capturing unit 50 is corresponding to a second lateral side (top side) 23 of the display 20, and the second lateral side 23 is perpendicular to the first lateral side 22.

In the embodiment of the invention, the notch 33 is formed on the supporting frame 30, and therefore there is sufficient space for disposing the antenna 40 at a lateral side of the housing 10. Utilizing the embodiment of the invention, the antenna 40 can be disposed at the right side or the left side of the display 20, the space at the top side of the display 20 is prevented from being occupied by the antenna 40, and sufficient space is preserved for the image-capturing unit 50 and other electronic elements. The noise of signal transmission can be reduced, and the performance of the antenna 40 is improved. In this embodiment, though the notch 33 is formed on the supporting frame 30, the supporting frame 30 still provides sufficient support for the display 20.

Figure 3:
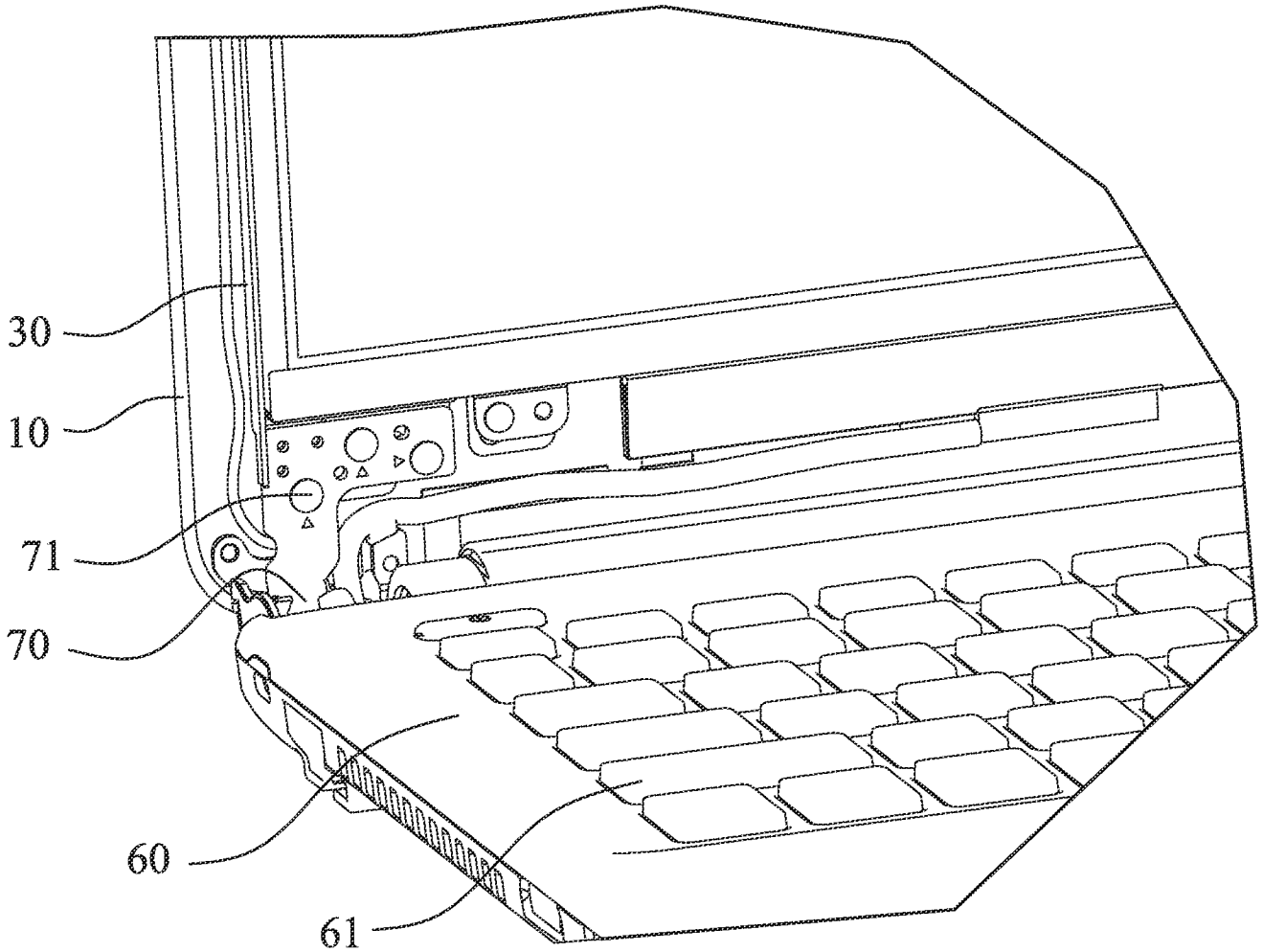
FIG. 3 shows a detailed structure of a pivot structure of the embodiment of the invention.

With reference to FIGS. 1 and 3, in one embodiment, the electronic device 1 is a notebook, which further comprises a device body 60 and a pivot structure 70. The supporting frame 30 is connected to the pivot structure 70. The housing 10 pivots on the device body 60 via the pivot structure 70. The device body 60 comprises an input interface 61. In this embodiment, the input interface 61 can be a keyboard, a touch panel or another input interface elements.

In the embodiment of the invention, the supporting frame 30 is utilized as a ground element, which provides sufficient ground area. Therefore, there is no copper foil ground layer coupled to the antenna being disposed between the housing 10 and the display 20. The assembly process is simplified and the cost is reduced. In one embodiment, with reference to FIG. 3, the supporting frame 30 can be electrically connected to the pivot structure 70 via a connection element 71 (for example, a rivet) to further increase the ground area of the antenna 40 and to achieve and improved ground effect.

Figure 4:
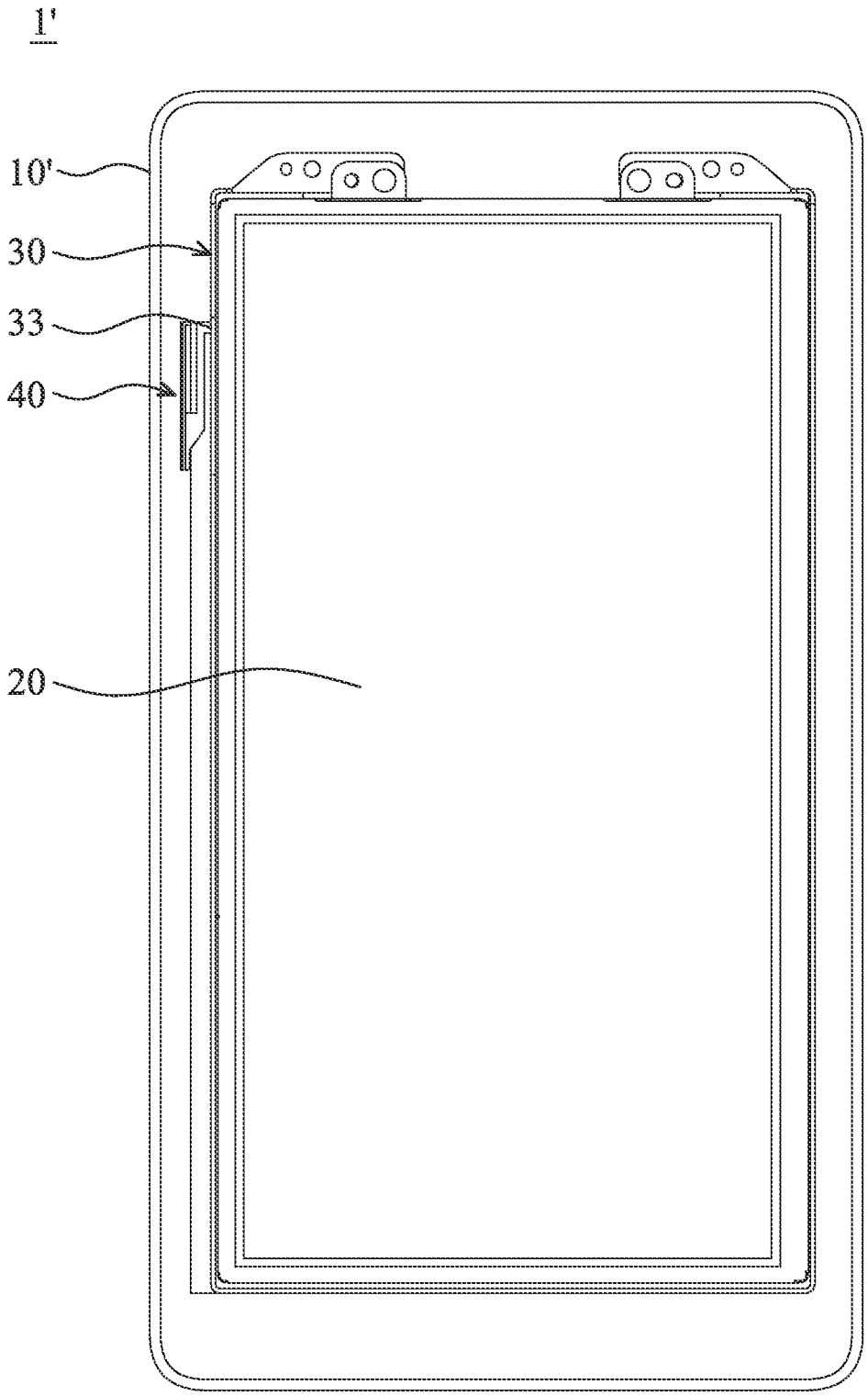
FIG. 4 shows an electronic device of another embodiment of the invention.

In the embodiment above, the electronic device is a notebook, but the invention is not limited thereto. The electronic device of the embodiments of the invention can be a tablet computer, a television and other electronic devices. FIG. 4 shows an electronic device 1' (tablet computer) of a modified example of the invention, which comprises a housing 10', a display 20, a supporting frame 30 and an antenna 40. The display 20 is disposed in the housing 10'. The supporting frame 30 contacts and supports the display 20. Similar to the embodiment of FIG. 2A, in the embodiment of FIG. 4, a notch 33 is formed on the supporting frame 30, and the notch 33 is corresponding to the antenna 40. With reference to FIG. 2A, the antenna 40 comprises a radiator 41 and a connection section 42. The connection section 42 is connected to the radiator 41, wherein the connection section 42 is coupled (connected) to the supporting frame 30. In one embodiment, the connection section 42 is connected to the supporting frame 30 by welding. The supporting frame 30 is grounded.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An electronic device, comprising:

a housing;

a display, disposed in the housing;

a supporting frame, wherein the supporting frame supports the display; and an antenna, comprising:

a radiator; and a connection section, connected to the radiator, wherein the connection section is coupled to the supporting frame, wherein the supporting frame comprises a first section and a second section, the first section is perpendicular to the second section, the first section abuts a back side of the display, the second section abuts a first lateral side of the display on a lateral plane, a notch is formed on the second section, wherein the notch lays on the lateral plane and the notch is corresponding to the antenna, wherein the first section supports the whole back side of the display, wherein the second section surrounds at least three sides of the display.

2. The electronic device as claimed in claim 1, wherein the supporting frame is grounded.

3. The electronic device as claimed in claim 2, further comprising a signal line and a ground line, the ground line is coupled to the supporting frame, and the signal line is coupled to the radiator.

4. The electronic device as claimed in claim 3, further comprising an image-capturing unit, wherein the image-capturing unit is disposed in the housing, the image-capturing unit is corresponding to a second lateral side of the display, and the second lateral side is perpendicular to the first lateral side.

5. The electronic device as claimed in claim 3, wherein the radiator comprises a first arm and a second arm, the first arm and the second arm are respectively connected to the connection section, an extension direction of the first arm is opposite to an extension direction of the second arm, and a distance between the first arm and the second section is about 5 mm.

6. The electronic device as claimed in claim 5, wherein the antenna further comprises a copper foil layer covering the first arm and the second arm.

7. The electronic device as claimed in claim 1, further comprising a pivot structure, and the supporting frame is connected to the pivot structure.

8. The electronic device as claimed in claim 7, further comprising a device body, wherein the housing pivots on the device body via the pivot structure, and the device body comprises an input interface.

9. The electronic device as claimed in claim 1, wherein there is no copper foil ground layer coupled to the antenna being disposed between the housing and the display.

10. The electronic device as claimed in claim 1, wherein a length of the notch is greater a length of the antenna.

11. The electronic device as claimed in claim 1, wherein the first section is sandwiched between the back side of the display and the housing.

12. An electronic device, comprising:

a housing;

a display, disposed in the housing;

a supporting frame, wherein the supporting frame supports the display, and a notch is formed on the supporting frame; and an antenna, corresponding to the notch, comprising:

a radiator; and a connection section, connected to the radiator, wherein the supporting frame comprises a first section and a second section, the first section is perpendicular to the second section, the first section abuts a back side of the display, the second section abuts a first lateral side of the display on a lateral plane, and the notch is formed on the second section, wherein the notch lays on the lateral plane, wherein the first section supports the whole back side of the display, wherein the second section surrounds at least three sides of the display.

13. The electronic device as claimed in claim 12, wherein the supporting frame is grounded.

14. The electronic device as claimed in claim 13, wherein the connection section is welded to the supporting frame.

15. The electronic device as claimed in claim 13, further comprising an image-capturing unit, wherein the image-capturing unit is disposed in the housing, the image-capturing unit is corresponding to a second lateral side, and the second lateral side is perpendicular to the first lateral side.

16. The electronic device as claimed in claim 13, wherein the radiator comprises a first arm and a second arm, the first arm and the second arm are respectively connected to the connection section, an extension direction of the first arm is opposite to an extension direction of the second arm, and a distance between the first arm and the second section is about 5 mm.

17. The electronic device as claimed in claim 16, wherein the antenna further comprises a copper foil layer covering the first arm and the second arm.

18. The electronic device as claimed in claim 12, further comprising a pivot structure, and the supporting frame is connected to the pivot structure.

19. The electronic device as claimed in claim 18, further comprising a device body, wherein the housing pivots on the device body via the pivot structure, and the device body comprises an input interface.

20. The electronic device as claimed in claim 12, wherein there is no copper foil ground layer coupled to the antenna being disposed between the housing and the display.

* * * * *